US005785459A

United States Patent [19]

Swinimer

[11] Patent Number: 5,785,459

[45] Date of Patent: Jul. 28, 1998

[54] PREFABRICATED FORM FOR MOLDING A FOOTING OF A SETTABLE STRUCTURAL MATERIAL

[76] Inventor: Kirk Swinimer, R.R. #1, Chester Basin, Nova Scotia, Canada, B0J 1K0

[21] Appl. No.: 682,269

[22] Filed: Jul. 17, 1996

[51] Int. Cl.[6] ..... E02D 5/66

[52] U.S. Cl. ..... 405/237; 405/229; 52/296; 249/13

[58] Field of Search ..... 405/231, 237, 405/244, 249, 256, 257, 238; 52/298, 296, 297, 100, 219; 249/11–13, 18, 19, 31, 32, 34, 48, 51, 117, 176, 143, 155

[56] References Cited

U.S. PATENT DOCUMENTS

| | | | |
|---|---|---|---|
| 1,296,995 | 3/1919 | Miller | 405/238 |
| 3,108,403 | 10/1963 | Jackson | 52/297 |
| 3,159,899 | 12/1964 | Pafenberg | 25/118 |
| 3,159,900 | 12/1964 | Pafenberg | 25/118 |
| 4,648,220 | 3/1987 | Gebelius | 405/237 X |
| 4,673,157 | 6/1987 | Wells | 405/257 X |
| 4,830,543 | 5/1989 | Joubert | 249/13 X |
| 5,271,203 | 12/1993 | Nagle | 52/298 X |

*Primary Examiner*—Tamara L. Graysay
*Assistant Examiner*—Frederick L. Laoman
*Attorney, Agent, or Firm*—Pearne, Gordon, McCoy and Granger LLP

[57] ABSTRACT

A prefabricated form for molding a footing of a settable structural material at the bottom end of a tubular form for a structural pillar is disclosed. The form is preferably constructed from a thermoplastic such as a high density polyethylene or ABS and is molded as a single disposable unit. The form is bell-shaped and has a sidewall which is inclined at an angle of about 45° to about 65° with respect to the bottom edge. A top flange of the form is preferably adapted to accommodate two or more different diameters of the tubular form for the structural pillar. The sidewall may include integral ribs which open inwardly to facilitate evacuation of air as the form is filled and to lend rigidity to the sidewall to ensure that it will not collapse if earth is backfilled around the form before the form is filled with settable material. The advantage is an inexpensive form which fills reliably without the entrapment of air pockets, supports a tubular form for a pillar without cross-pieces, may be left in the ground and actually protects the footing from the intrusion of water, etc. Thus significant savings in labor and a significant improvement in the quality of footings for structural pillars made using tubular forms is realized.

16 Claims, 5 Drawing Sheets

PREFABRICATED FORM FOR MOLDING A FOOTING OF A SETTABLE STRUCTURAL MATERIAL

FIELD OF THE INVENTION

This invention relates to forms for molding settable materials such as concrete, polymer concrete or the like and, in particular, to forms for molding footings for structural pillars used in the construction industry.

BACKGROUND OF THE INVENTION

The use of structural pillars in the construction industry is well known and widely practiced. Such pillars are constructed using a settable material such as concrete which is typically poured into a tubular form. Tubular forms made of spirally wrapped paper are well known and commonly used for this purpose. Structural pillars are usually set on a coarse aggregate bed to ensure good drainage. The aggregate bed is normally laid in a trench dug below the level of maximum frost penetration to minimize movement due to frost heaving. A footing for each pillar is required between the aggregate bed and the pillar to distribute weight and provide adequate support for the pillar and its load. Traditionally, the forms for this footing have been built in situ using plywood or wooden planks which are cut to form a rectangular frame that is nailed together and set on the aggregate bed. The rectangular frame generally includes at least one cross-piece for supporting the tubular form for the pillar. There are several disadvantages to this practice. First, the cutting and nailing together of materials for the form for the footing is labour intensive and time consuming. Second, such forms do not generally fill properly when concrete is fed through the top of the tubular form. Usually, at least the corners of the form are not properly filled. In addition, air pockets often form around the cross-piece for supporting the tubular form, and the cross-piece itself must be left in the concrete after it is set and the form is removed. All of these factors contribute to an inferior footing which is subject to the intrusion of water that may damage and weaken the footing. Besides, unless the top of the footing form is closed, earth cannot be backfilled around the form before the concrete is poured. This often contributes to inconvenience and unfavourable working conditions. Besides, even if the top of the footing form is closed, most building codes require that any forming material made of wood be removed before backfilling. This is because buried wood holds moisture, which can cause frost damage.

There therefore exists a pressing need for a simple, inexpensive prefabricated form which eliminates these disadvantages.

Prefabricated molds for concrete are known and taught, for instance, in U.S. Pat. Nos. 3,159,899 and 3,159,900 which issued respectively on Dec. 8, 1964 to Pafenberg. Each of these patents teach a mold for attaching anchor weights to the legs of children's yard swing sets. The mold is incorporated permanently in the anchor weight and provides a decorative outer covering for the anchor weight. While the molds taught by Pafenberg are well suited for their intended purpose, they are not adapted for use as a form for a footing for use in conjunction with tubular forms for pillars.

SUMMARY OF THE INVENTION

It is an object of the invention to provide an inexpensive prefabricated form for molding a footing of a settable structural material at a bottom end of a tubular form for a structural pillar.

It is another object of the present invention to provide a prefabricated form for molding a footing of a settable structural material at a bottom end of a tubular form for a structural pillar, which is shaped to ensure that the form is completely filled without entrapped air pockets when the settable material is poured through a top end of the tubular form attached thereto.

It is yet a further object of the invention to provide a prefabricated form for forming a footing of a settable structural material at a bottom end of a tubular form for a structural pillar which is adapted to accommodate a plurality of diameters of tubular forms for pillars.

In accordance with a preferred embodiment of the invention, there is provided a prefabricated form for molding a footing of a settable structural material at a bottom end of a tubular form for a structural pillar, comprising:

- a substantially frusto-conically shaped hollow body having a circular top end and a circular bottom end spaced below and concentric with the top end, and an integral sidewall that extends between the top end and the bottom end, the sidewall being inclined at an angle in a range of about 45° to about 65° with respect to a plane of a bottom edge of the bottom end;
- a bottom flange that extends radially from the bottom edge of the bottom end;
- a top flange that extends axially from the top end, the top flange being adapted for the connection of at least one diameter of the tubular form, whereby the prefabricated form is positioned on a suitable substrate in a location where a structural column is required, a tubular form is frictionally engaged with the top flange and both forms are filled with the settable material from a top end of the tubular form to construct the structural column either before or after earth is backfilled around the forms.

The invention therefore provides a prefabricated form for molding a footing of a settable structural material at a bottom end of a tubular form for a pillar. The form is preferably molded from a thermoplastic resin such as high density polyethylene or ABS, although any other rigid, water resistant material with adequate strength is also suitable. The form is molded as a unit and is bell-shaped in profile. It includes a bottom end with a radial flange and a top end having a top flange that is sized to frictionally engage a tubular form of a specific diameter. The flange on the top end may be adapted to engage the tubular form either internally or externally, but preferably it is adapted to engage the form externally and it is preferably adapted to the connection of a plurality of different diameters of the tubular form.

Furthermore, in accordance with the preferred embodiment of the invention there is also provided an adapter which permits the connection of one or more tubular forms of a smaller diameter to the prefabricated footing form. This increases the versatility of the prefabricated form. Alternatively, the prefabricated footing form can be manufactured in a range of sizes so that a single form is not universally adapted to accommodate a wide range of diameters of tubular forms for a pillar.

A principal advantage of the prefabricated footing form is that it can be left in the ground, so backfilling can take place before concrete is poured, obviating the hazard of open trenches. Furthermore, the form actually protects a footing which it covers from the intrusion of moisture and other potentially damaging substances, therefore prolonging the life of a footing that it encases.

BRIEF DESCRIPTION OF THE DRAWINGS

The invention will now be described by way of example only and with reference to the following drawings, wherein.

DETAILED DESCRIPTION OF THE PREFERRED EMBODIMENT

Figure 1:
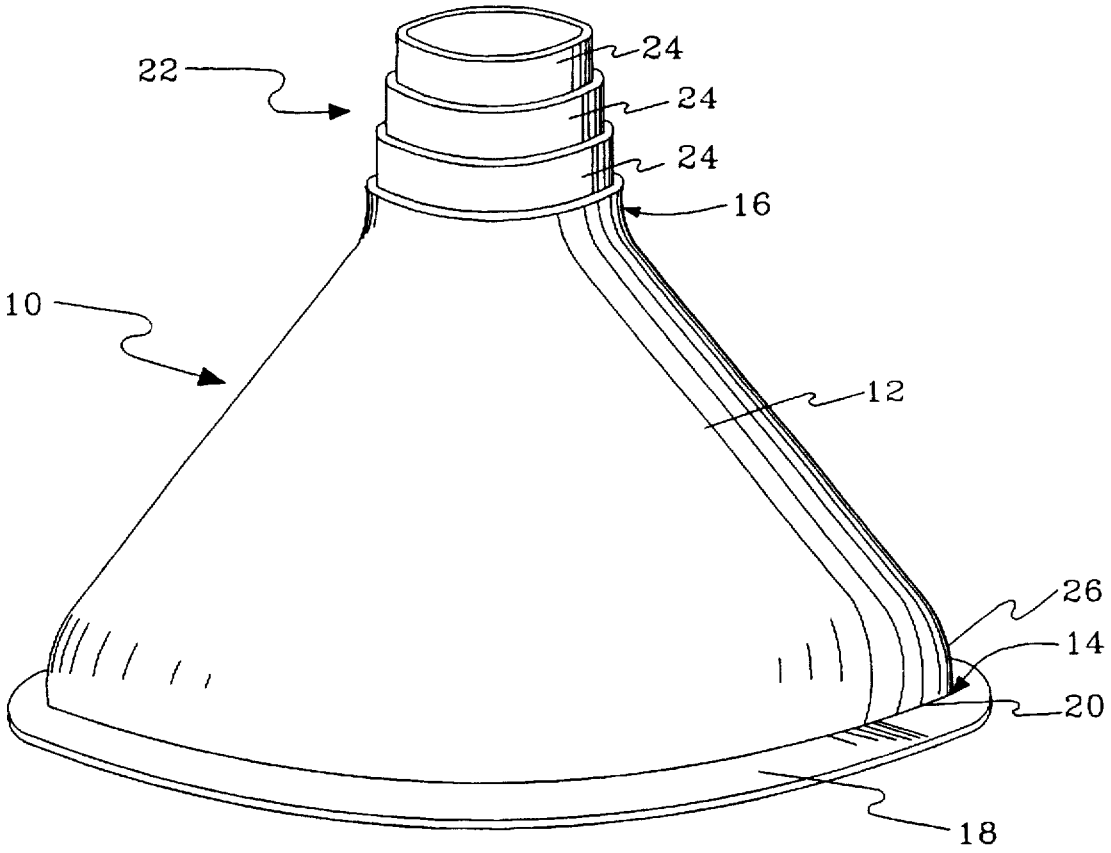
FIG. 1 is a perspective view of a first embodiment of the prefabricated form in accordance with the invention.
Figure 6:
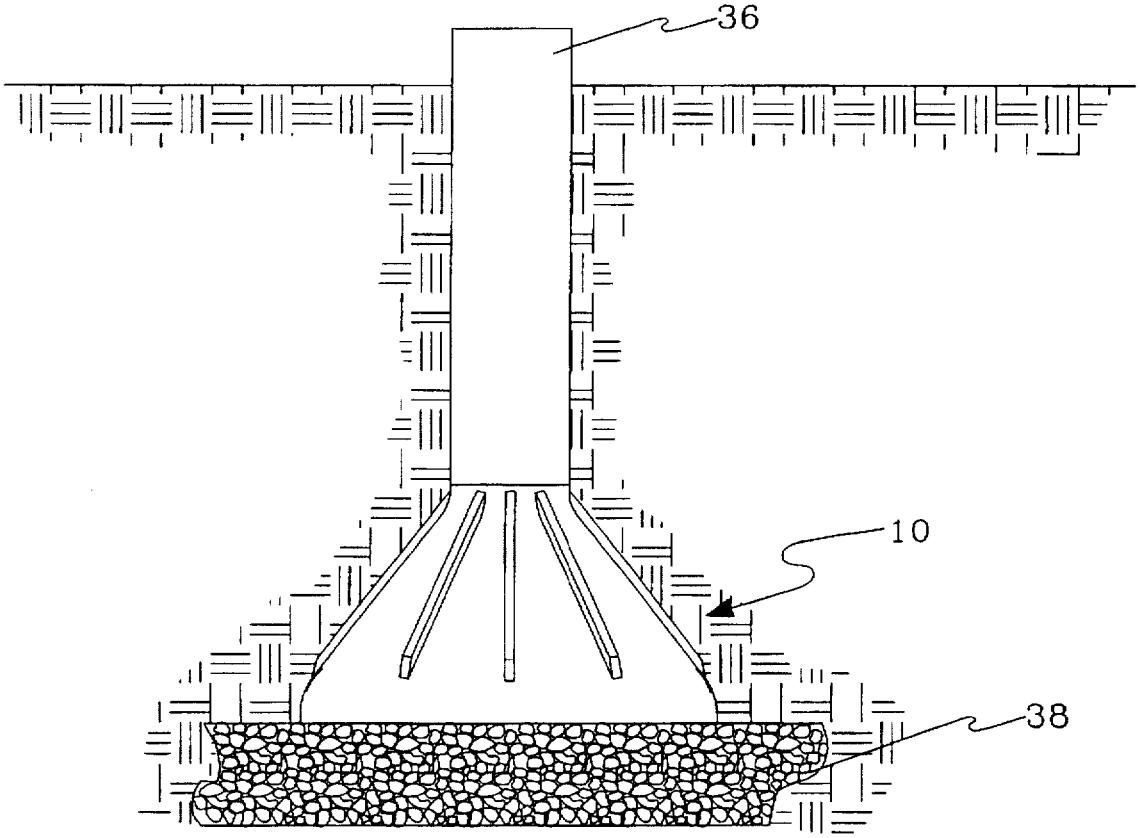
FIG. 6 is an elevational view of the form shown in FIG. 2 in situ ready to be filled with a settable material.

FIG. 1 shows a perspective view of a first embodiment of a prefabricated form 10 in accordance with the invention. The prefabricated form 10 includes a sidewall 12 having a bottom end 14 and a top end 16. The sidewall 12 is preferably inwardly inclined at an angle of about 45° to about 65° to facilitate the evacuation of air when the form is filled with a settable material. Integral with a bottom edge 20 of the bottom end 14 is a radial bottom flange 18. Integral with the top end 16 is an axial top flange 22. The top flange 22 preferably includes a plurality of inwardly stepped connectors 24 having an outer diameter that is sized to frictionally engage an inner surface of a tubular form for a structural pillar when the tubular form is forced down over a one of the connectors 24, as will be described below with reference to FIG. 6. At the top end 16, the sidewall 12 is curved to smoothly merge with the top flange 22. This provides a finished pillar and footing combination cast with a prefabricated form in accordance with the invention in connection with a tubular form as shown in FIG. 6 with an additional structural advantage. Due to the smooth curvature at the point of juncture between the finished footing and the pillar, the stress point usually present at this juncture with conventional forming methods caused by the sharp angle between the pillar wall and the footing top surface is avoided. As a result, cracking of the finished column at this juncture upon movement of the surrounding soil is substantially prevented. At the bottom end 14, the prefabricated form 10 also preferably includes a short axially-oriented portion 26 which extends upwardly from the bottom flange 18 for about 3" to provide a robust base for the footing.

Figure 2:
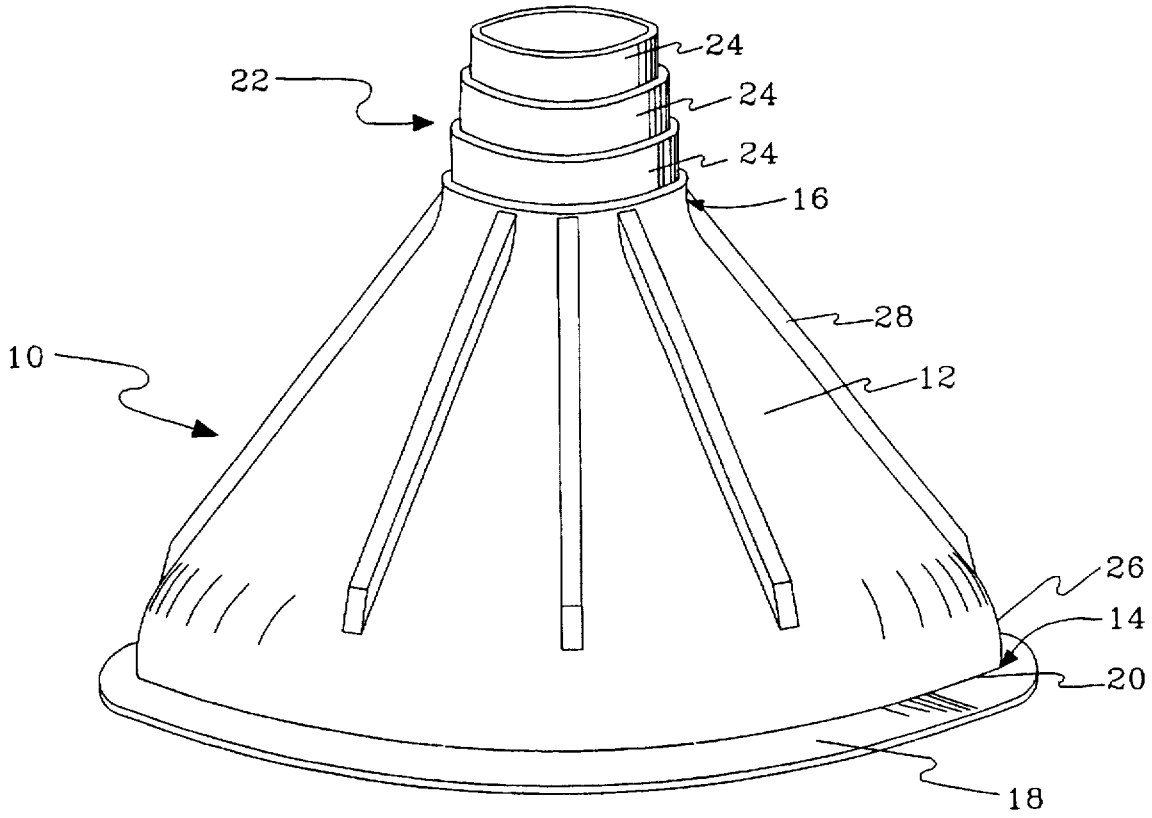
FIG. 2 is a perspective view of another embodiment of the prefabricated form in accordance with the invention.

FIG. 2 shows a perspective view of another embodiment of the invention wherein the sidewall 12 includes a plurality of reinforcing ribs 28. The reinforcing ribs 28 are integrally molded with the sidewall and open inwardly. They preferably extend from the axially-oriented portion 26 of the bottom end 14 to a base of the axial top flange 22. In the preferred embodiment of the invention, the reinforcing ribs 28 are straight and equally spaced apart. They serve to reinforce the sidewall so that it is self supporting in the event that earth is backfilled around the prefabricated form 10 before it is filled with a settable material such as concrete. The reinforcing ribs 28 also provide channels which further facilitate the evacuation of air as the form is filled with concrete from the top as will be explained below with reference to FIG. 6. It should be noted that the reinforcing ribs 28 are not necessary to ensure that air is evacuated from the prefabricated form 10. The form 10 with or without reinforcing ribs 28 fills reliably without the entrapment of air when it is filled from the top because the angle of about 45° to about 65° of the sidewall 12 ensures that the form fills completely without the entrapment of air.

Figure 3:
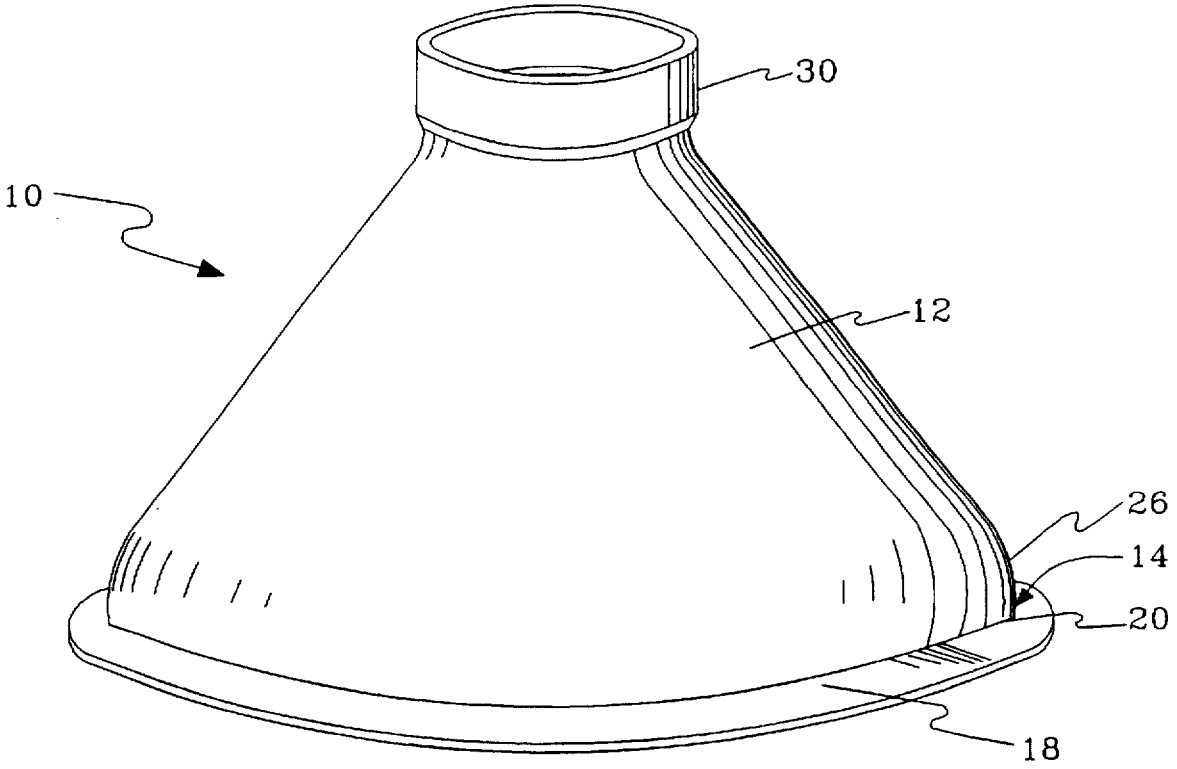
FIG. 3 is a perspective view of yet another embodiment of the prefabricated form in accordance with the invention.

FIG. 3 is a perspective view of yet another embodiment of the prefabricated form in accordance with the invention. This embodiment is identical to the embodiment shown in FIG. 1 with the exception of the top flange. An alternate top flange 30 is adapted to receive a tubular form for a structural pillar internally of the flange 30. Otherwise, the two forms are identical. It should be noted that this alternate flange 30 is adapted to accept an adapter for changing the size of tubular form which may be connected to the prefabricated form 10, as will be explained below with reference to FIG. 5.

Figure 4:
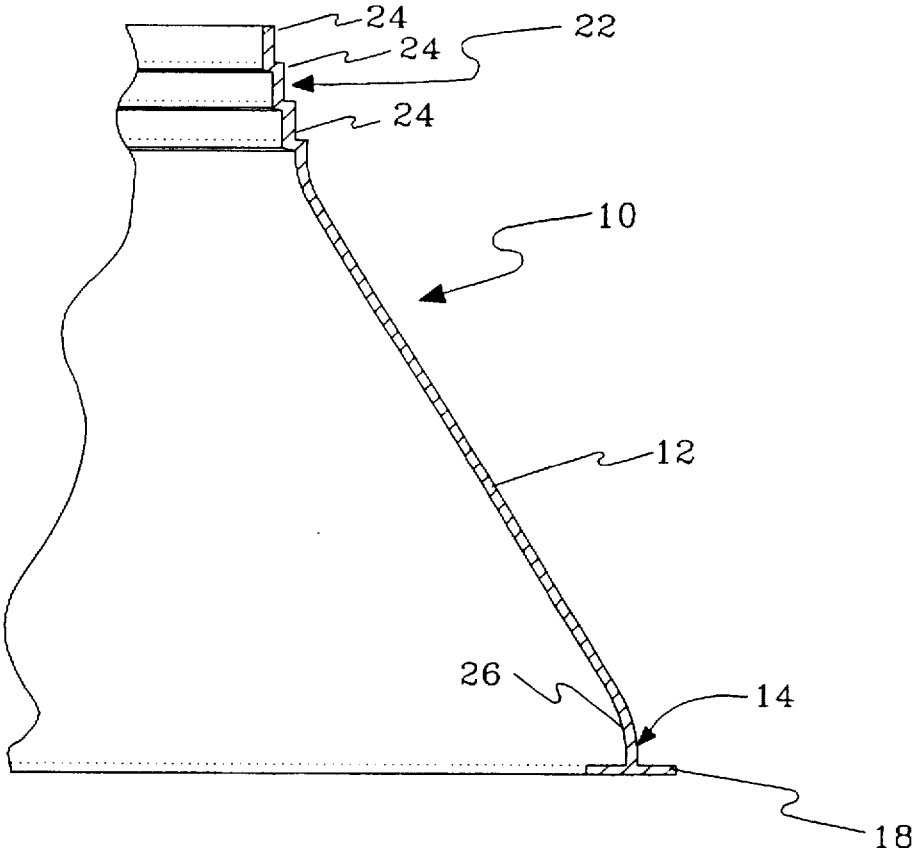
FIG. 4 is a partial cross-sectional view of the embodiment shown in FIG. 1.

FIG. 4 is a partial cross-sectional view of the embodiment of the invention shown in FIG. 1. The radial bottom flange 18 may extend outwardly in the plane of the bottom edge 20 or inwardly, or both outwardly and inwardly as shown in the drawing. If the bottom flange 18 extends inwardly, it tends to prevent the form 10 from floating up when it is filled, in the event that earth is not backfilled around the prefabricated form 10 before it is filled with a settable material such as concrete. It should be noted, however, that the prefabricated form 10 has much less tendency to float up when filled with concrete than wooden forms built in situ. As described above, the top flange 22 preferably includes a plurality of connectors 24 which are adapted for the connection of different sizes of tubular forms for structural columns. Tubular forms are sold in a range of diameters and this construction of the axial top flange 22 increases the versatility of the prefabricated mold 10. It should also be noted that each connector 24 is tilted slightly inwardly from an axial orientation. This is to permit a tubular form to slip easily over a top edge of a connector 24 and securely frictionally engage the connector as the tubular form is forced over the connector into contact with the slightly wider base of each connector 24.

Figure 5:
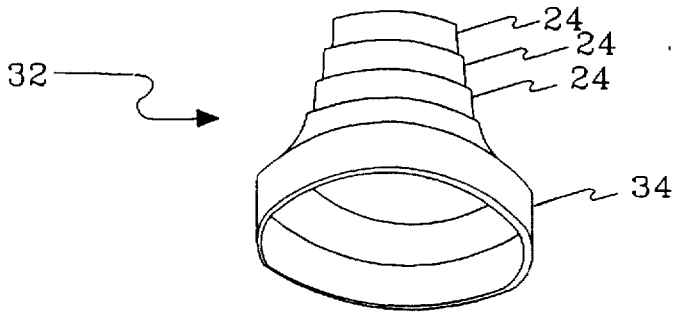
FIG. 5 is a perspective view of an adapter in accordance with the invention for increasing the range of sizes of tubular forms that can be attached to the prefabricated forms shown in FIGS. 1–3.

FIG. 5 is an elevational view of an adapter 32 for reducing the size of an axial top flange 22, 30 of the prefabricated form 10 in accordance with the invention. The adapter 32 includes a plurality of connectors 24 that are shaped substantially identically to the connectors 24 shown in FIG. 4. The adapter 32 includes a bottom flange 34 which is adapted to fit over the top connector 24 of the top flange 22 shown in FIG. 4. The bottom flange 34 is also adapted to fit inside a properly sized top flange 30 of the embodiment shown in FIG. 3. In either instance, an adapter 32 may provide up to at least three connectors 24 for the connection of additional smaller sizes of tubular forms for structural pillars.

FIG. 6 is an elevational view of the form shown in FIG. 2 in situ ready to be filled with a settable material such as wet concrete. As explained above, a tubular form 36 commonly sold under the trade-mark SONO TUBE is forced over a connector 24 (see FIGS. 1 or 2) or into a connector 30 (see FIG. 3) of a prefabricated form 10 in accordance with the invention. Form 10 illustrated in FIG. 6 is the form shown in FIG. 2 and includes reinforcing ribs 28. Normally, structural pillars are set on an aggregate bed 38 which is positioned in a trench below the normal frost penetration zone for the area in which the pillar is required for structural support. If the connector 24 to which the tubular form 36 connects is not the top most connector, any connectors 24 located above the connector used may be cut off using a hand saw or the like before the tubular form 36 is seated to ensure that the structural column is not weakened by the presence of the connectors. After the tubular form 36 is fitted to the prefabricated form 10 for the footer and the prefabricated form 10 is located in a proper position on the aggregate bed 38, the trench may be backfilled with earth in order to ensure that the form remains in its location while the settable material such as concrete is poured into the form. The backfilling not only stabilizes the form in its position, it also permits better access to a top end of tubular form 36 and eliminates the potential hazard of working around open trenches, etc. After the form is in position, whether backfilled or not, reinforcing steel may be inserted into the tubular form 36, as required, and a settable material such as concrete poured through the top of the tubular form 36 until both prefabricated form 10 for the footing and the tubular form 36 are filled as required. The prefabricated forms in accordance with the invention preferably have a diameter at the bottom end of about 12" to about 28" and a height of about 12" to about 18", depending on the size of the tubular form 36.

As explained above, the shape of the prefabricated form 10 ensures that the footing is filled to capacity without the entrapment of air which is evacuated along the sidewall 12 and up through the tubular form 36 as the settable material is poured in through the top of the tubular form 36. A solid, optimally shaped footing for supporting a structural column is thereby reliably produced with a minimum of expense and effort. The rigid connection of the tubular form 36 to the prefabricated form 10 for the footing not only ensures that work progresses rapidly, it also ensures that each structural pillar is placed with precision. As well, as noted above, the form can be left in the ground and actually protects the footing from moisture, thus minimizing the risk of frost damage. Thus, a significant advance in the art is realized.

Modification to above-described preferred embodiments of the invention may become apparent to those skilled in the art. The scope of the invention is therefore intended to be limited solely by the scope of the appended claims.

I claim:

1. A prefabricated form for molding a footing of a settable structural material at a bottom end of a tubular form for a structural pillar, comprising:

a substantially frusto-conically shaped rigid hollow body having a circular top end and a circular bottom end spaced below and concentric with the top end, and an integral sidewall that extends between the top end and the bottom end, the sidewall being inclined at an angle in the range of about 45° to about 65° with respect to a plane of a bottom edge of the bottom end;

a bottom flange that extends radially from the bottom edge of the bottom end;

a top flange that extends axially from the top end, the top flange being adapted for the connection of at least one diameter of the tubular form, whereby the prefabricated form is positioned on a suitable substrate in a location where a structural pillar is required, a tubular form is frictionally engaged with the top flange and both forms are filled with the settable material from a top end of the tubular form to construct the structural pillar either before or after earth is backfilled around the forms.

2. A prefabricated form for molding a footing of a settable structural material at a bottom end of a tubular form for a structural pillar as claimed in claim 1 wherein the sidewall is reinforced by a plurality of integral ribs that extend at least a part of the way between the bottom end and the top end.

3. A prefabricated form for molding a footing of a settable structural material at a bottom end of a tubular form for a structural pillar as claimed in claim 2 wherein the sidewall includes an axially-oriented portion that extends upwardly a short distance from the bottom edge and the plurality of reinforcing ribs comprise a plurality of equally spaced-apart straight ribs that extend from a top edge of the axially-oriented portion of the sidewall to a base of the top flange.

4. A prefabricated form for molding a footing of a settable structural material at a bottom end of a tubular form for a structural pillar as claimed in claim 3 wherein the reinforcing ribs open inwardly to provide air channels to promote the evacuation of air from the form as the form is being filled with the settable material through the tubular form for the pillar.

5. A prefabricated form for molding a footing of a settable structural material at a bottom end of a tubular form for a structural pillar as claimed in claim 1 wherein the bottom flange extends radially outwardly from the bottom edge.

6. A prefabricated form for molding a footing of a settable structural material at a bottom end of a tubular form for a structural pillar as claimed in claim 1 wherein the bottom flange extends radially inwardly from the bottom edge.

7. A prefabricated form for molding a footing of a settable structural material at a bottom end of a tubular form for a structural pillar as claimed in claim 1 wherein the form is molded from a plastics material.

8. A prefabricated form for molding a footing of a settable structural material at a bottom end of a tubular form for a structural pillar as claimed in claim 7 wherein the plastics material is a thermoplastic material.

9. A prefabricated form for molding a footing of a settable structural material at a bottom end of a tubular form for a structural pillar as claimed in claim 8 wherein the thermoplastics material is an injection molded high density polyethylene.

10. A prefabricated form for molding a footing of a settable structural material at a bottom end of a tubular form for a structural pillar as claimed in claim 8 wherein the thermoplastics material is a vacuum molded ABS.

11. A prefabricated form for molding a footing of a settable structural material at a bottom end of a tubular form for a structural pillar as claimed in claim 1 wherein the bottom end includes a flange that extends radially outwardly therefrom in a plane coincident with the bottom edge, and the sidewall includes an axially-oriented portion that extends upwardly a short distance from the bottom edge.

12. A prefabricated form for molding a footing of a settable structural material at a bottom end of a tubular form for a structural pillar as claimed in claim 1 wherein the top flange is adapted to accommodate the attachment of at least three different diameters of the tubular form for the pillar.

13. A prefabricated form for molding a footing of a settable structural material at a bottom end of a tubular form for a structural pillar as claimed in claim 1 wherein the flange on the bottom end extends both radially inwardly and outwardly form the bottom edge.

14. A prefabricated form for molding a footing of a settable structural material at a bottom end of a tubular form for a structural pillar as claimed in claim 1 wherein the bottom end has a diameter of about 12" to about 28" and the top end is spaced about 12" to about 18" above the bottom edge.

15. A prefabricated form for molding a footing of a settable structural material at a bottom end of a tubular form for a structural pillar (as claimed in claim 1 wherein the form further includes) comprising:

a substantially frusto-conical shaped rigid hollow body having a circular top end and a circular bottom end spaced below and concentric with the top end, and an integral sidewall that extends between the top end and the bottom end, the sidewall being inclined in an angle in the range of about 45° to about 65° with respect to a plane of a bottom edge of the bottom end;

a bottom flange that extends radially from the bottom edge of the bottom end;

a top flange that extends axially from the top end, the top flange being adapted for the connection of at least one diameter of the tubular form, an adapter for mounting to the top flange, the adapter being adapted to permit the connection of at least one diameter of the tubular form for the pillar that is smaller than the smallest diameter of the top flange, whereby the prefabricated form is positioned on a suitable substrate in a location where a structural pillar is required, the tubular form is frictionally engaged with the top flange and both forms are filled with a settable material from a top end of the tubular form to construct the structural pillar either before or after earth is backfilled around the forms.

16. A prefabricated form for molding a footing of a settable structural material at a bottom end of a tubular form for a structural pillar, comprising:

a substantially tapered rigid hollow body having a top end of a first area and a bottom end of a second area larger than the first area and concentric with the top end, and an integral side wall extending between the top end and the bottom end, the side wall being inclined at an angle in the range of about 45° to about 65° with respect to a plane of a bottom edge of the bottom end; and a circular top flange that extends axially from the top end, the top flange being adapted for the connection of at least one diameter of the tubular form, whereby the prefabricated form is positioned on a suitable substrate in a location where a structural pillar is required, a tubular form is frictionally engaged with the top flange and both forms are filled with the settable material from a top end of the tubular form to construct the structural pillar either before or after earth is backfilled around the forms.

* * * * *